US005144707A

United States Patent [19]

Callaway et al.

[11] Patent Number: 5,144,707

[45] Date of Patent: Sep. 8, 1992

[54] FLOTATION SYSTEM INCLUDING IMPROVED LOCKING FEATURES

[75] Inventors: Milton A. Callaway, Dahlonega; Charles E. Steed, Alpharetta, both of Ga.

[73] Assignee: Simmons Company

[21] Appl. No.: 673,203

[22] Filed: Mar. 21, 1991

[51] Int. Cl.[5] ..... A47C 27/08

[52] U.S. Cl. ..... 5/451; 5/470

[58] Field of Search ..... 5/451, 450, 449, 455, 5/452, 422, 470, 400, 201

[56] References Cited

U.S. PATENT DOCUMENTS

| | | | |
|---|---|---|---|
| 4,266,307 | 5/1981 | Critelli | 5/470 |
| 4,371,998 | 2/1983 | Callaway | 5/451 |
| 4,680,820 | 7/1987 | Bittner | 5/451 |
| 4,932,088 | 6/1990 | Johenning et al. | 5/470 |

*Primary Examiner*—Alexander Grosz

[57] ABSTRACT

A water mattress configuration including a top cover interconnected with a lower member or members in order to capture on or move liquid-filled bladders therebetween. In one embodiment, such interconnection is made by a sliding connection allowing the top cover to "glide" into place. Another embodiment contemplates interconnecting by hooked members entering slots.

9 Claims, 6 Drawing Sheets

FLOTATION SYSTEM INCLUDING IMPROVED LOCKING FEATURES

TECHNICAL FIELD

This invention relates in general to bedding, and more particularly to flotation bedding systems including improved locking features for maintaining one or more water- or other fluid-filled bladders within a cavity in order to provide a supporting surface for sleeping or reclining thereon. Important features of the invention include sliding or "gliding" features, as well as particular locking features.

BACKGROUND OF THE INVENTION

In bedding configurations, a need has been recognized for configurations which provide comfortable supporting surfaces. It is known in the art to include water- or other fluid-filled bladders in order to support a user thereon. For example, U.S. Pat. No. 3,585,356 to Hall, entitled "Liquid Support for Human Bodies", hereby incorporated by reference, discloses an article of furniture comprising a flexible bladder which is substantially filled with a liquid. In Hall, a supporting framework is provided for holding the liquid filled bladder in such a manner such that a body resting on the bladder is floatably supported by the liquid.

U.S. Pat. No. 4,015,299 to Tinnel, entitled "Water Bed", hereby incorporated by reference, discloses a water bed construction including an upwardly opening rectangular "coffer" formed by polyurethane sheet and a polyurethane perimetrical members disposed thereon. The coffer cavity receives and contains a water mattress, and a foam pad is disposed thereon.

U.S. Pat. No. 4,221,013 to Echevarria, entitled "Fluid Floatation Sleep System", hereby incorporated by reference, discloses a fluid flotation system including a pair of registering frame members, which combine to capture one or more fluid-filled bladders therein.

U.S. Pat. No. 4,245,362 to Mueller, and U.S. Pat. No. 4,245,362 to Callaway, each entitled "Flotation Mattress", hereby incorporated by reference, each disclose the use of springs in combination with foam in order to capture a fluid-filled bladder therein.

Although the above configurations do include features having distinct advantages, a need has still been recognized to provide a waterbed system which is simple to assemble and utilize. Furthermore, a need has been recognized for a waterbed system having an interior which is easy to access for display and/or maintenance, but also may be readily closed to maintain its interior components securely therein.

SUMMARY OF THE INVENTION

The present invention provides an improvement over the prior art by satisfying the above criteria, in part by providing an improved cavity locking system which may be easily unlocked in order to access the interior bladder-holding cavity for promotional display or maintenance, but may also be easily and securely therein.

Generally described, the present invention provides a water mattress construction which includes an improved perimeter locking system.

It is an object of the present invention to provide a bedding configuration having an improved supporting surface.

It is a further object of the present invention to provide a bedding configuration which may be displayed for promotional purposes.

It is a further object of the present invention to provide a bedding configuration which includes a smooth sliding or "gliding" assembly feature.

It is a further object of the present invention to provide a bedding configuration having an interior which may be displayed for promotional purposes.

It is a further object of the present invention of provide a flotation bedding configuration which may be easily assembled by a typical consumer.

It is a further object of the present invention to provide a flotation bedding configuration having an interior cavity which may be easily accessed by a typical consumer.

It is a further object of the present invention to provide a flotation bedding configuration having an interior cavity which may be easily closed and secured by a typical consumer.

It is a further object of the present invention to provide a flotation bedding configuration having improved means for detecting leaks and punctures in its bladder or bladders.

It is a further object of the present invention to provide a flotation bedding configuration having a built-in maintenance recorder.

Other objects, features, and advantages of the present invention will become apparent upon reading the following detailed description of the preferred embodiment of the invention when taken in conjunction with the drawings and the appended claims.

DETAILED DESCRIPTION OF THE PREFERRED EMBODIMENT

This is in reference to the drawings, in which like numerals represent like parts throughout the several views. For purposes of this application, various references may be made to elements being "upper" or "lower" relative to other elements. Of course, it should be understood that such terms "upper" and "lower" are merely relative as to point of reference of the viewer. Furthermore, terms such as "head" and "foot" ends of the mattress are used in order for ease of discussion. It should be understood that such terms are used in order to differentiate ends so identified and should not be interpreted as limiting. In describing the mattress, it will be assumed that its "bottom" is resting on a horizontal supporting surface.

First Preferred Embodiment

Figure 4:
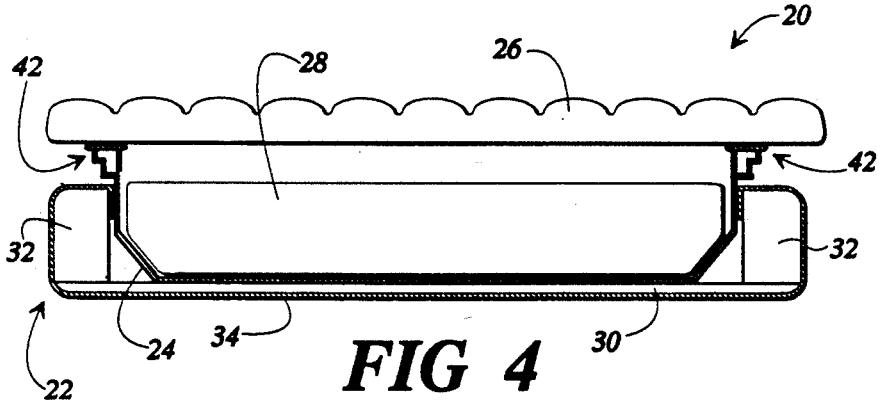
FIG. 4 is an end cross-sectional semi-exploded view of the mattress assembly according to a first embodiment of the invention.

Referring to FIG. 4, it illustrates a first preferred mattress embodiment 20 of the invention, which generally includes a base 22, a plastic tray 24 disposed within the base, and a top cover 26 atop the base-tray combination. The tray 24 and cover 26 combine to define an interior cavity which accepts a water- or other fluid-filled bladder 28 (or more than one bladder). A person positioned atop the cover 26 may be at least partially supported by the fluid bladder or bladders.

Figure 1:
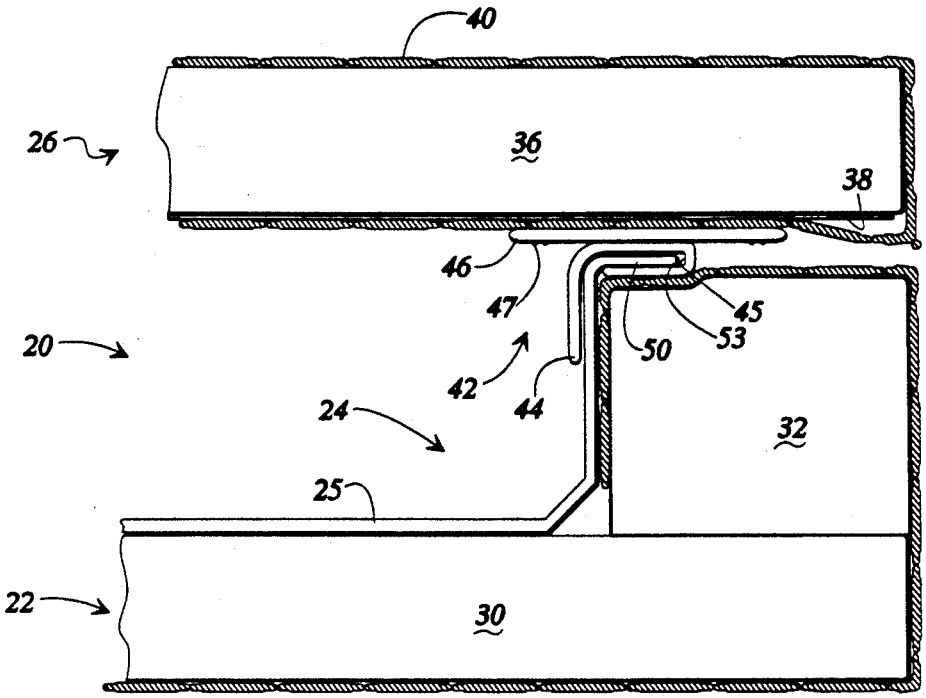
FIG. 1 is a partial cross-sectional view of a portion of a first embodiment of the invention, illustrating the interlocking of the side flange of a tray with a corresponding channel assembly.

Referring now also to FIG. 1, the base 22 itself includes a flat bottom foam layer 30, a foam perimeter 32, and an overlayer of quilting or other decorative fabric 34. The bottom layer 30 is substantially uniform in thickness, and has a substantially rectangular shape, having upper and lower primary planar surfaces being substantially parallel, two substantially parallel side surfaces, and two substantially parallel "head" and "foot" end surfaces. The foam perimeter 32 extends about the marginal edges of the lower layer 30, and is attached to its upper primary planar surface by glue or other attachment means known in the art. The foam perimeter in the preferred embodiment is composed of four elongate foam members, each having a substantially rectangularly-shaped transverse cross section and being substantially straight. The ends of the four foam members meet in order to combine to make a continuous foam perimeter rectangular in shape.

It should be understood that other configurations could be used in providing such a base; a large block of material could be used which is "hollowed" out by suitable machining practices known in the art. Furthermore, a bottom layer may not be used as in another embodiment shown below.

The tray 24 includes a floor portion 25 (see FIG. 1 only), as well as two side walls and two end walls. Each of the four walls of the tray extends upwardly from the floor portion and includes an inclined wall portion extending upwardly from the floor portion, and a vertical wall portion extending upwardly from the inclined wall portion. From each of the two side walls of the tray extends a horizontally-disposed side flange 50, and from each of the two end walls of the tray extends a horizontally-disposed end flange 52 (discussed in further detail below).

In this embodiment the tray is composed of a single layer of plastic or other suitable material which is molded into a mold through a process known in the art as "vacuum molding". However, other configurations may be used, and it is not necessary that the tray of unitary construction.

Figure 2:
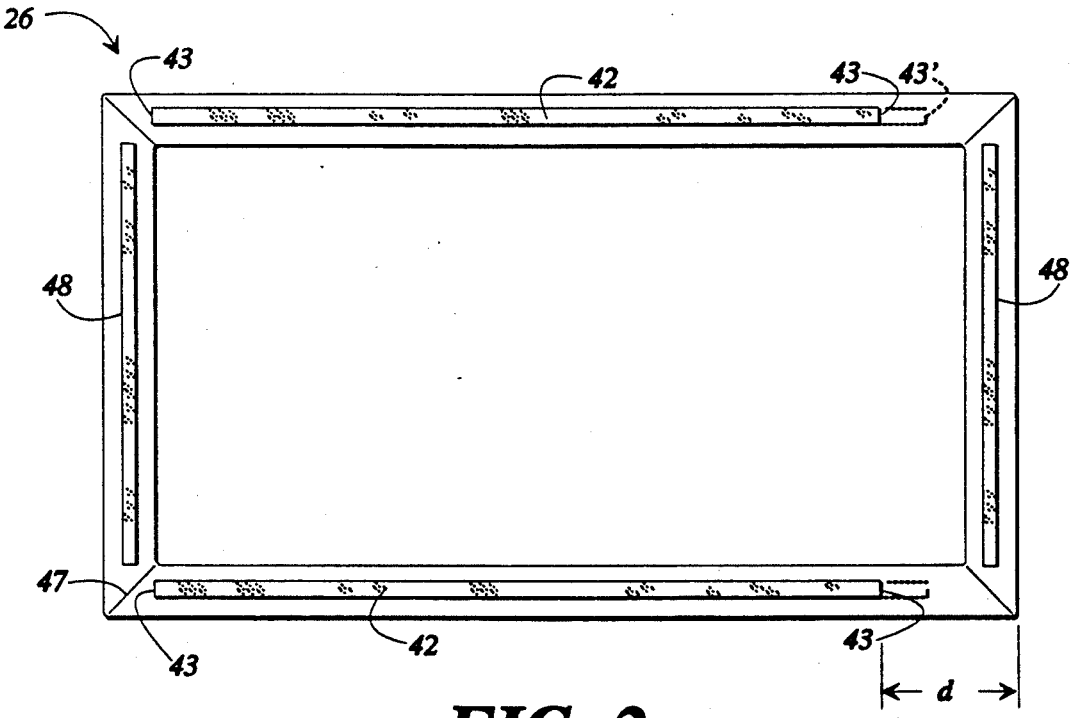
FIG. 2 is a bottom plan view of the top cover of a first embodiment of the invention.

The top cover 26 includes a rectangular foam layer 36 with a fabric layer 38 positioned beneath the foam layer 36, and a layer of quilting 40 positioned over the top of the foam layer 36 and partially overlapping the fabric layer 38. As shown in FIG. 2, the fabric 38 is folded at the corners of the top cover in an abutting relationship at 47.

A pair of elongate channel assemblies 42 extend along the lower surface of the top cover 26. In the preferred embodiment, each channel assembly 42 is coextruded, including a channel portion 44 being of a first plastics material (PVC in this embodiment), and a top flange portion 46 which is of a second plastics material less rigid than the material composing portion 44 (latex rubber in the preferred embodiment). The flange portion 46 is sewn at 47 or otherwise attached to the underside of the top cover 26.

Referring now also to FIG. 2, it may be seen that the pair of channel assemblies 42 extend only partly along the entire length of the top cover 26 with their longitudinal axes being substantially coparallel. At the "head" and "foot" ends of the top cover 26 are positioned a pair of fastening strips 48, each attached to the underside of the top cover 26. These fastening strips 48 are either the "hook" or "loop" elements of a typical hook-and-loop connecting system such as that known in under the VELCRO® trademark. These fastening strips 48 cooperate with two fastening strips 49, one each attached at the head and foot ends of the base (see FIG. 3).

Figure 3:
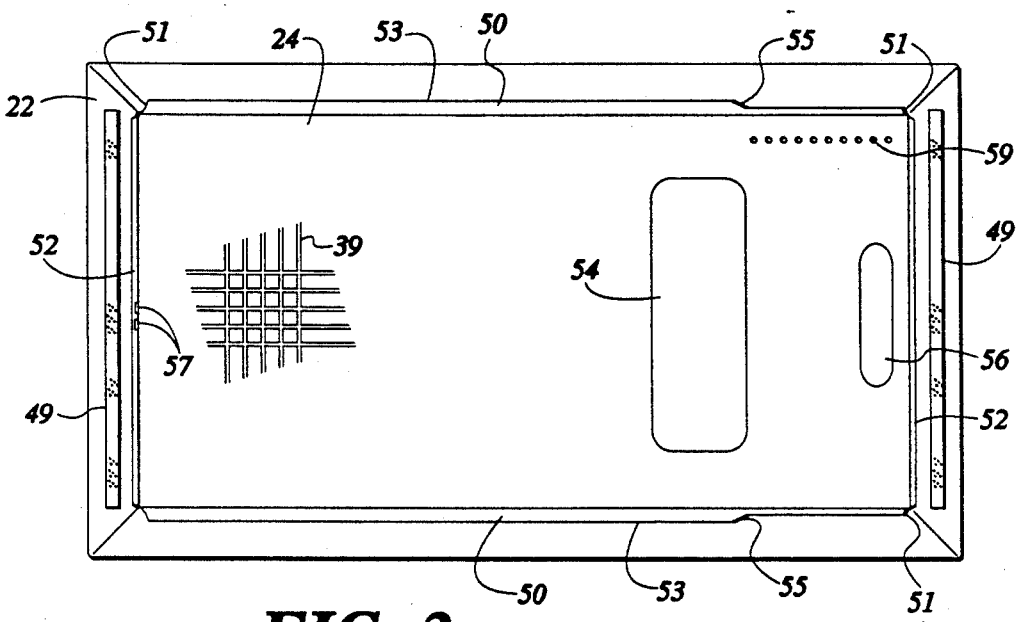
FIG. 3 is a top plan view of the tray and base of a first embodiment of the invention, without any water-filled bladders in place within the tray.

In FIG. 3, the tray 24 is shown nested within the upwardly-disposed cavity of the base 22. At the sides of the tray extend a pair of opposing side flanges 50 (see also FIG. 1), which extend in an opposing relationship and each terminate in an edge 53. The flanges 50 are accepted by the channel portion 44 of the channel assembly 42 as best shown in FIG. 1, but discussed in further detail below.

At the "head" and the "foot" of the tray 24 extend a pair of vertical flanges 52 which extend in an opposing relationship to each other. In the preferred embodiment shown in FIG. 3, it may be understood that these flanges 52 do not extend outwardly from the end walls of the tray as much as do the flanges 50 extend from the side walls. In an alternative embodiment, flanges 52 may be non-existent, in order to reduce the potential that they will be felt by one sitting at the head or foot of the mattress.

The upwardly-disposed tray 24 may include an upwardly-disposed water heater reservoir 54, as well as a fluid reservoir 56. It may be understood that each of these reservoirs is provided by a portion of the floor of the tray 24 extending downwardly somewhat relative to an adjacent portion. In the case of the heater reservoir (which is in place in order to situate a typical water bed heater), it may be preferable that this reservoir be situated within a "plateau", thus maintaining the heater, although itself in a depression, somewhat above the main floor of the tray to prevent contact with leaking water. In the case of the fluid reservoir depression, it is preferably that this depression 56 be the lowermost portion of the floor of the tray 24, with as much of the floor as possible being inclined toward the depression, such that water leaking from anywhere within the tray tends to be directed into the depression 56. A pair of "snap-slots" 57 (see FIG. 3) are provided in the head end wall of the tray to secure a heater cord passing thereover.

The tray 24 includes a calendar 59, which is basically a plurality of depressions configured to accept a peg. Each of the depressions are assigned a particular date, in order that the user may recall his or her last date of servicing the mattress.

Interaction of the channel assemblies 42 with the two flanges 50, which allows the top cover 26 to be attached to the tray, is now discussed.

As may be seen in FIG. 3, the side flanges 50 are tapered somewhat at their ends 51, and there is a step-down of the flanges at 55. This is to facilitate ease of insertion of these ends 51 into the "head" ends 43 of the channel assemblies 42.

Figure 5:
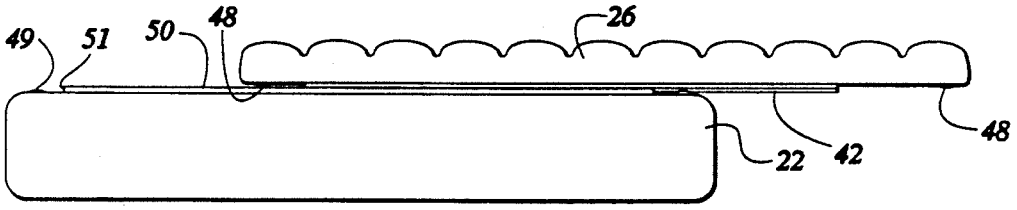
FIG. 5 is a side illustrative view of the manner in which the top cover of the first embodiment is "slid" into place.

Referring now also FIG. 5, it will be assumed that the base 22 is positioned atop a substantially horizontal supporting surface such as a foundation or box spring. The top cover 26 is positioned such that the longitudinal axes of the channel assemblies 42 are substantially parallel with the longitudinal axes of the elongate side flanges 50 of the tray, and the top cover is at the "foot" end of the base and tray. The leading "head" ends 43 of the channel assemblies 42 are then positioned relative to the "foot" ends of the flanges 50, such that the flanges 50 enter within the channel 45 defined by the channel portion 46 of the channel assemblies 42. The top cover is then continuously urged toward the head of the base and tray (either by pulling or pushing) such that more and more of the lengths of the flanges 50 are slidably accepted within their corresponding channel assemblies 42. Eventually, the top cover 26 will be positioned such that it is covering the bladder 28 and basically is in registration with the base, such that its fastening strips 48 are facing fastening strips 49 of the base 22. At this time, a downward pressure may be provided in the location of the fastening strips 48, 49, in order to insure their coengagement.

Figure 6:
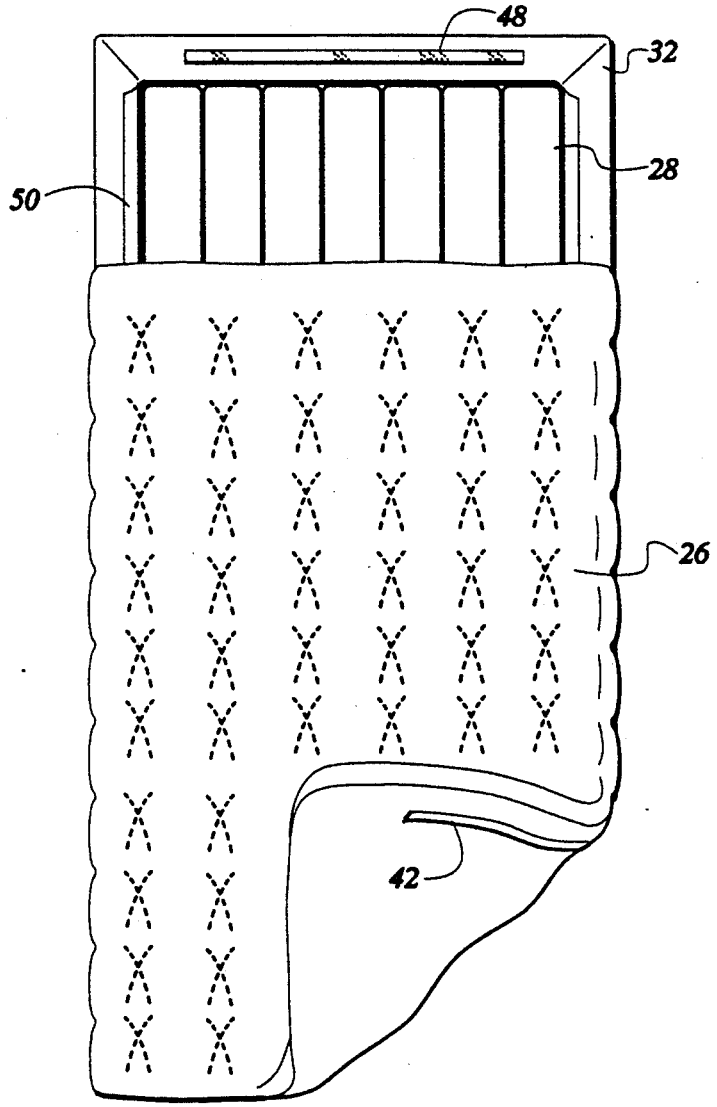
FIG. 6 is a top illustrative view of the manner in which the top cover of the first embodiment is "slid" into place, with a portion of the top cover bent back to illustrate the positioning of a channel assembly. Multiple water-filled bladders are shown in place.

The above sliding or "gliding" feature is an important part of the invention. It may be seen that a smooth assembly action is provided, which is easy for even the least skilled user to perform. Such a feature is well illustrated in FIG. 6.

As described above, the preferred insertion of the top cover is from the foot of the base and tray. However, it may be understood that the cover 26 may, in this preferred embodiment, be "slid in" from either and (head or foot) of the base.

As may be seen with respect to FIG. 2, the elongate channel assemblies 42 attached to the top cover 26 do not extend the entire length of the top cover, instead stopping short of the ends of the cover. It may be seen that a certain distance "d" exists between the "foot" ends 43 of the channel assemblies 42 and the ends of the top cover 26.

Figure 7:
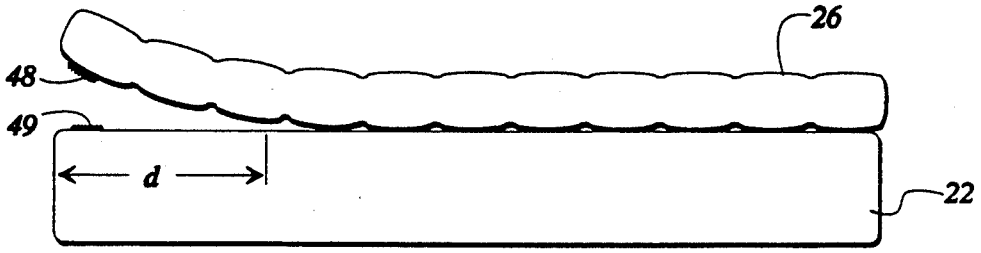
FIG. 7 is a side illustrative view of the manner in which a portion of the top cover of the first embodiment is bent out of place in order to access the interior of the mattress.

Referring now also to FIG. 7, it may be seen that this distance d provides for access to the interior cavity of the mattress 20, without initiation of the previously-discussed sliding motion. Instead, at the foot end of the assembly 20, the previously-discussed engagement of one pair of the respective fastening strips 48, 49, of the top cover 26 and base 22 may be disengaged. Upon such disengagement, the top cover, being flexible, may be bent out of the way as shown in FIG. 7 to provide access to the interior of the mattress 20.

This access may serve at least two purposes. First of all, typically in displaying such mattresses for promotional and/or sale purposes, it is often desired to illustrate at least a portion of the mattress in its completely assembled state. However, at the same time, there is also a need to illustrate the inner elements of the mattress construction, not least of all the bladder or bladders contained therein, in order to promote or exhibit potentially marketable aspects of the mattress construction. The water mattress according to the present invention provides for such a need.

Secondly, after a water mattress has been obtained by a purchaser, there is an obvious need to allow the consumer to easily access the interior elements of a water mattress, without undue burden which is often required in disassembling prior art constructions. However, as may be seen, at least the foot end of the water mattress may be easily accessed without totally removing the top. As the heaters, thermostats, etc. may be positioned at such end, the mattress may be readily serviced or maintained without the requirement that the top cover 26 be entirely removed by the above-reference sliding motion. Access to the head end of the mattress could be provided by shortening the channel assemblies at that end.

It may be understood that the channel assemblies may be shorter or longer as desired without departing from the spirit and scope of the present invention. For example, one of its ends may extend as shown at 43 in FIG. 2. Furthermore, the length of the edge flanges 50 could be shortened or lengthened to allow the top cover to be bent out of the way to the extent it is not connected to the tray.

Figure 8:
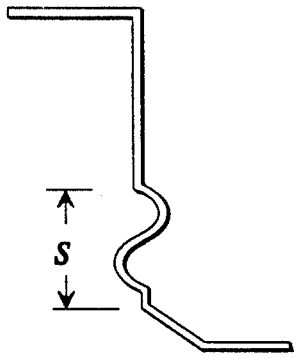
FIGS. 8 and 9 are cross-sectional views of alternate side walls of a tray, including "spring portions".
Figure 9:
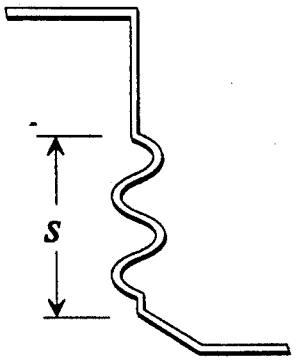

Referring now to FIGS. 8 and 9, an alternative tray wall design is illustrated, which includes a spring region "S" in the side wall of the tray, which allows for vertical deflection of the side walls of the tray, which may be desired if a person is lying or sitting at a location immediately above the side walls.

It may be understood that it is not necessary that the above-described spring region be curvilinear in form. Other configurations are also contemplated which allow a wall to be deflected along its length.

Second Preferred Embodiment

Figure 10:
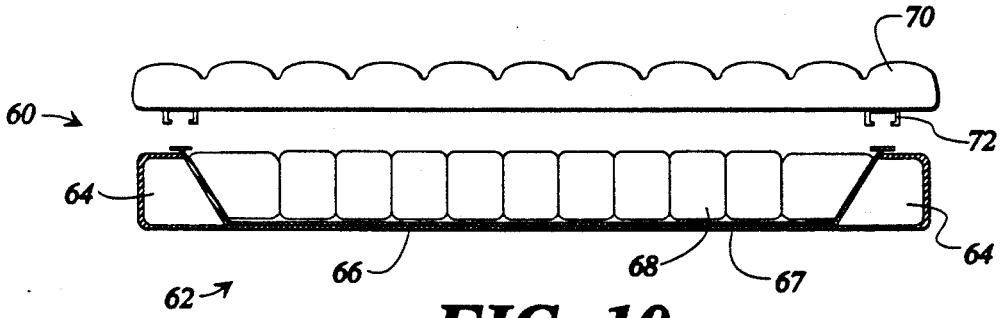
FIG. 10 is an end cross-sectional semi-exploded view of the mattress assembly according to a second embodiment of the invention.

Referring now to FIG. 10, a second preferred embodiment of the second invention is illustrated. A water mattress 60 is illustrated, which includes a base 62 (including a foam perimeter 64), a tray 66, and a plurality of fluid-containing bladders 68 positioned within the tray, and a top cover 70. Channel assemblies 72 are attached to the underside of the top cover 70.

The base 62 does not include a flat "bottom" member (although it could), but instead only includes a rectangularly-shaped foam perimeter 64 composed in the preferred embodiment of four elongate foam members. The transverse cross sections of the four members of the perimeter 64 are similar and each includes a vertical outside side surface, horizontal upper and lower side surfaces, and an inclined interior side surface. A fabric layer 67 extends completely underneath the foam perimeter, and wraps at least partially around the perimeter as well.

The side walls of the tray 66 shown in FIG. 10 are inclined outwardly at a slope approximating that of the interior side surfaces of the perimeter 64, in order to encourage nesting of the two elements.

Figure 11:
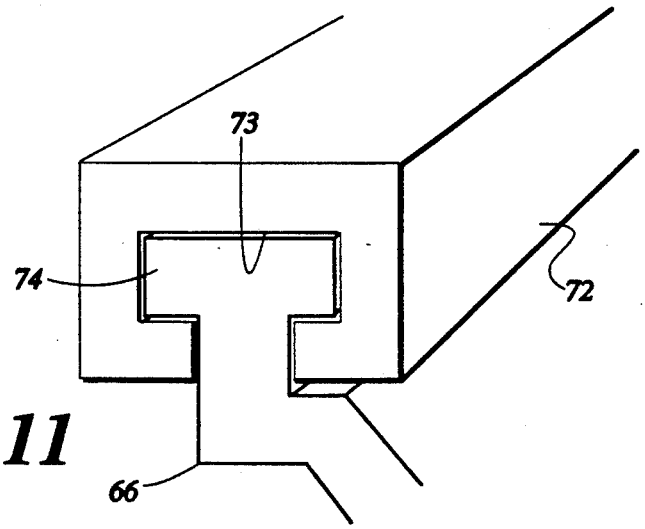
FIG. 11 is an isolated view illustrating the sliding connection between the top cover and tray of the assembly of FIG. 10.

Referring now also to FIG. 11, each of the two channel assemblies 72 defines an interior channel 73, which is configured to accept the T-shaped cross-section of elongate T-shaped members 74 provided at the upper side edges of the tray 66. As in the previously-described first embodiment, these assemblies 72 may not extend completely the length of the mattress 60, but may stop short in order to provide access to the ends of the mattress as described above. The hook-and-loop configurations described above may also be used in this configuration.

Third Preferred Embodiment

Figure 12:
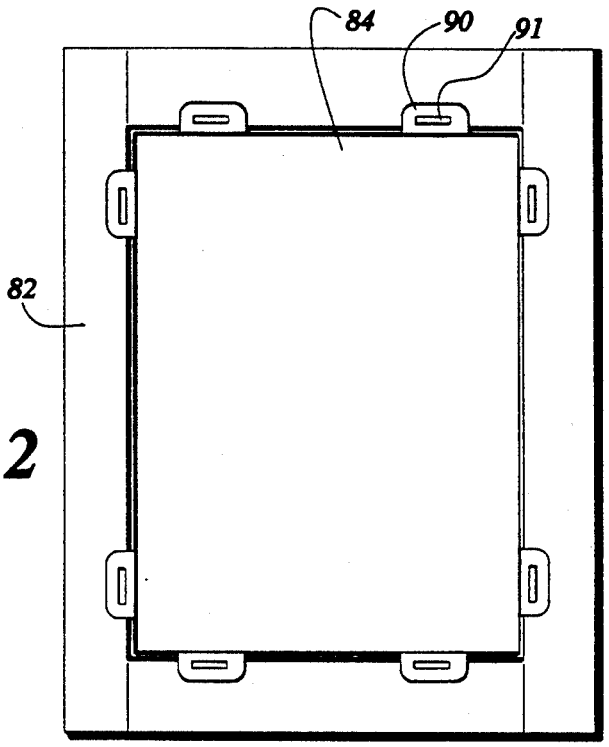
FIG. 12 is a top plan view of the tray and base of a third embodiment of the invention, without any water-filled bladders in place within the tray.
Figure 13:
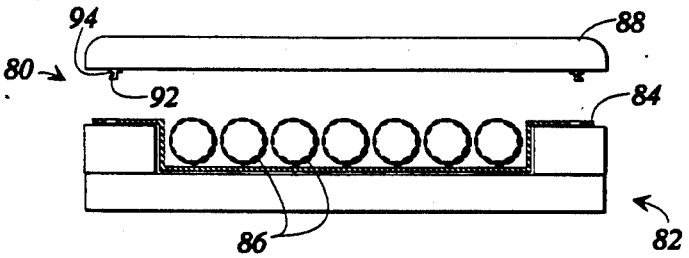
FIG. 13 is a side cross-sectional semi-exploded view of the mattress assembly according to a third embodiment of the invention.

Referring now to FIGS. 12 and 13, a third preferred embodiment of the present invention is described. A mattress 80 includes a base 82, which itself accepts a tray 84 nested therein. The tray 84 likewise accepts a plurality of elongate fluid-filled bladders 86 therein. Atop the bladders and base 82 is positioned a top cover 88. The bladders can run head-to-foot or side-to-side, although they are shown side-to-side in FIG. 12.

The base 82 of this embodiment is similar to that shown in FIG. 1 and includes a lower foam layer having a rectangularly-shaped foam perimeter attached along its marginal edges on its upper surface.

Figure 14:
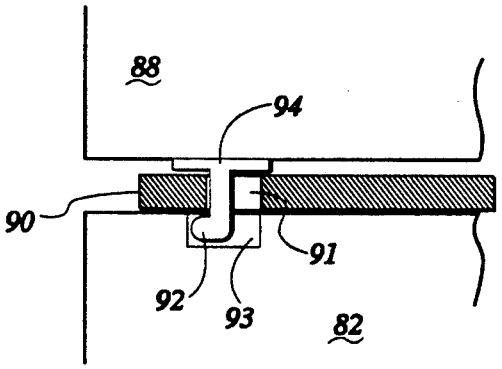
FIG. 14 is an isolated view illustrating the interlocking between the top cover and the tray of the embodiment shown in FIG. 13.

The tray 84 includes a floor with four side walls extending upwardly therefrom. From the upper edge of each of the walls extends a pair of vertically-extending tabs 90 each of which, as also shown in FIG. 14, includes a slot 91. Eight engagement elements 94 are attached to and extend downwardly from the underside of the top cover 88. These elements 94 correspond to the eight tabs 90, with their slots 91 each configured to accept a hooked protrusion 92 extending from an engagement element 94. The hooked protrusions each define a "shelf" or "shoulder" for engagement purposes. The engagement elements 94 may be attached to the underside of the top member 88 by sewing, gluing, or other attachment means known in the art.

It may be understood that, in order to assemble mattress 80, the previously-discussed "sliding" process is not utilized. Instead, the top member 88 is positioned above and preferably in registration with the base 82, with the tray 84 positioned within the cavity of the base 88, and the bladders within the cavity of the tray. The top cover 88 is then brought downwardly such that each of the hooked protrusions 92 of the engagement elements 94 enters into a corresponding slot 91 defined by tabs 90. Cavities 93 in the perimeter of the base (see only FIG. 14) allow for clearance of the hooked protrusions. Some downward pressure may be necessary in order to fully engage the hooked protrusions 92 into place. Thereafter, it is only necessary to disengage a few adjacent hooked protrusions from their position in order to bend the top member 88 out of place to access the bladder or bladders thereunder.

It may be seen that the hooked protrusions 92 each have their "barb" or "hook" extending outwardly relative to the center of the mattress. It may be understood that this is advantageous in that when a load is placed atop the cover 88, the hooked protrusions may tend to be urged outwardly, which encourage, engagement of the hooked protrusions.

Fourth Preferred Embodiment

Figure 15:
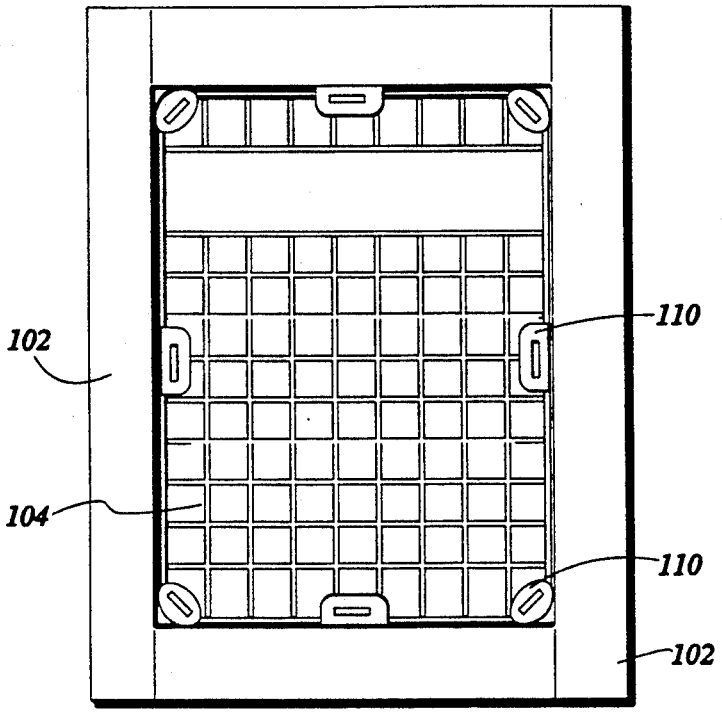
FIG. 15 is a top plan view of the tray and base of a fourth embodiment of the invention, without any water-filled bladders in place within the tray.
Figure 16:
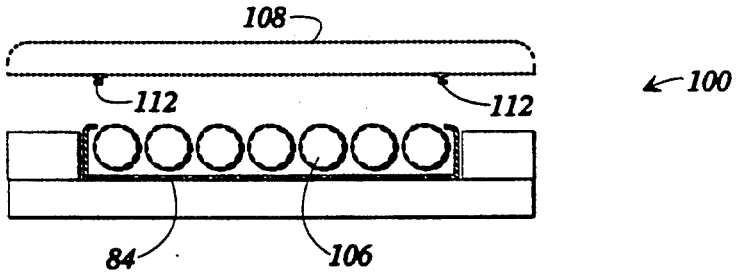
FIG. 16 is a side cross-sectional semi-exploded view of the mattress assembly according to a fourth embodiment of the invention, with the top cover shown in phantom.

Referring now to FIG. 15, another embodiment of the invention is described. A mattress 100 includes a base 102, a tray 104, a plurality of bladders 106 within the tray, and a top cover 108 covering the base, tray, and bladders.

Figure 17:
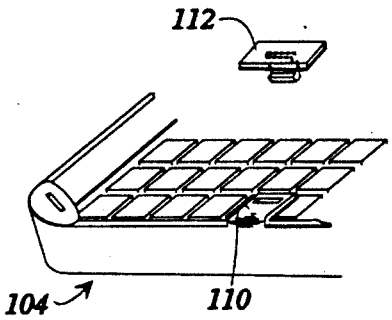
FIG. 17 is a partial view of the tray of the fourth embodiment, illustrating the interaction of an engagement member with one of the tabs extending from the edge of the tray.

The base 102 is similar to some of those described above, in that it includes a flat bottom foam layer, and a perimeter of foam. The tray 104 has a floor, and four vertical walls extending upwardly from the edges of the floor. The tray 104 also includes a plurality of tabs 110, which extend inwardly relative to the upper edges of the tray side walls, shown in detail in FIG. 17. As in the previously-discussed embodiment, a plurality of engagement elements 112 are attached and extend downwardly from the lower surface of the top cover 108. These engagement elements 112 correspond in number to the tabs 110, and engage the tabs in a manner similar to that discussed with respect to the embodiment illustrated in FIGS. 12–14. Once again, the engagement elements included hooked protrusions including "barbs" or "hooks" which extend outwardly relative to the center of the mattress.

Figure 18:
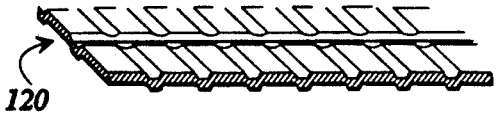
FIG. 18 is a partial view of floor of the tray of the fourth embodiment.

The floor of the tray 104 may include a plurality of ribs or channels to direct leakage as well as to provide structural rigidity, as illustrated at 120 in FIG. 18. A similar configuration may be provided in the other embodiments such as shown at 39 in FIG. 3.

It may be noted that detents or stops could be provided in the sliding engagement elements connecting the cover and base, in order that the installer be aware when the top is in its properly installed location.

It may also be understood that the top cover member may be in engagement (through the sliding or locking features) with the tray or the base members, or both. It is simply preferred that such a top cover member be so engaged with a "lower member", which may be understood as a tray, a base member, or the two combined.

It may also be understood that other materials may be substituted for the above-discussed hook-and-loop material in order to attach the ends of the top cover to the base. For example, a snap connection or zippers may be used.

Leak-proof liners may be interposed intermediate many of the above-discussed elements without departing from the spirit and scope of the present invention. For example, a liner may be interposed intermediate the water bladder(s) and the tray shown in FIG. 1. A liner may also be used underneath the tray.

Coil springs, including pocketed coil springs may also be used in the perimeter without departing from the spirit and scope of the present invention.

As discussed above, more than one bladder may be used within the above-discussed trays. Furthermore, fabric or other material known in the art may be used inside the bladders in order to reduce wave effects therefrom.

The bladders or "water bags" are configured to hold water or other fluids therein. The bladder may be composed or 20 mil vinyl or other acceptable bladder material known in the art.

With respect to configuration of FIG. 4, it may also be understood that the positioning of the hook-and loop fastening strips may be exchanged for the positioning of the channel assemblies and their respective flanges. In such a configuration, the top cover would be "slid" in from one side of the base.

While this invention has been described in specific detail with particular reference to the disclosed embodiments, it will be understood that many variations and modifications may be effected within the spirit and scope of the invention as described in the appended claims.

What is claimed is:

1. A water mattress construction, comprising:

a lower member including a base member including an upwardly-disposed cavity at least partially defined by a perimeter;

a liquid-filled bladder positioned atop said lower member;

an upper member positioned atop said bladder, said upper member combining with said lower member to at least partially define a cavity at least partially containing said bladder;

sliding interconnection means to connect said upper and lower members, said interconnection means itself comprising:

a first elongate channel member defining a channel portion; and a first elongate flange member having a portion slidably fitting within said channel portion, said first elongate channel member attached to one of said upper and lower members, said first elongate flange member attached to the other of said upper and lower members, and one of said said first elongate channel member and said first elongate flange member being attached to said perimeter, such that a sliding interconnection is provided between said upper and lower members; and a detachable connection independent of said sliding interconnection means, said detachable connection intermediate said top and bottom members and configured to provide a portion of said top member to be bent out of place to allow access to said bladder without disengaging said sliding interconnection means.

2. The construction claimed in claim 1 wherein said detachable connection is hook-and-loop constuction.

3. The water mattress construction as claimed in claim 1, wherein said lower member includes a tray portion and a base portion, wherein said tray portion includes a floor and at least one upwardly-disposed side wall, and wherein said flange member extends from said said wall.

4. A water mattress construction, comprising;

a base portion defining a floor and an upstanding perimeter;

a tray portion disposed atop said base portion, said tray portion including a floor portion and at least one upstanding side wall, and an elongate flange portion extending outwardly from said side wall;

a top portion disposed atop said tray portion, said top portion combining with said tray to define an inner cavity;

a liquid-filled bladder within said cavity and at least partially resting on said floor and said wall of said tray portion; and a channel member attached to said top portion, said channel member defining a channel portion configured to accept said flange portion of said tray such that a sliding interconnection is provided intermediate said top member and said tray member to provide selective access to said bladder.

5. The water mattress as claimed in claim 4, further comprising a detachable connection independent of said sliding interconnection, said detachable connection intermediate said top portion and said tray portion and configured to provide a portion of said top member to be bent out of place to allow access to said bladder without disturbing said sliding interconnection.

6. The water mattress as claimed in claim 5, wherein said detachable connection intermediate said top portion and said tray portion is of hook-and-loop construction.

7. The water mattress as claimed in claim 4, wherein said elongate flange portion extending from said side wall is a first elongate flange portion extending from a first side wall, and said tray portion further comprising a second side wall having a second elongate flange portion extending in opposing direction with respect to said first flange, and further comprising a second elongate channel member attached to said top member and defining a channel portion configured to accept said second flange portion of said tray such that a load placed atop said top portion tends to encourage more engagement of said flange portions within their corresponding channel members.

8. The water matress as claimed in claim 7, further comprising a detachable connection independent of said sliding interconnection, said detachable connection intermediate said top portion and said tray portion and configured to provide a portion of said top member to be bent out of place to allow access to said bladder without disturbing said sliding interconnection.

9. The water mattress as claim in claim 8, wherein said detachable connection intermediate said top portion and said tray portion is of hook-and-loop construction.

* * * * *